United States Patent [19]

Orii

[11] 4,414,887

[45] Nov. 15, 1983

[54] PRESS SECONDARY MACHINING LINE CONTROL DEVICE

[75] Inventor: Takeshi Orii, Isehara, Japan

[73] Assignee: Kabushiki Kaisha Orii Jidoki Seisakusho, Japan

[21] Appl. No.: 353,993

[22] Filed: Mar. 2, 1982

[51] Int. Cl.[3] ..... B30B 15/30

[52] U.S. Cl. ..... 100/45; 72/405; 72/419; 100/48; 100/207

[58] Field of Search ..... 100/43, 45, 48, 207; 72/405, 419

[56] References Cited

U.S. PATENT DOCUMENTS 3,948,162 4/1976 Numba ..... 100/45

FOREIGN PATENT DOCUMENTS 2757170 6/1979 Fed. Rep. of Germany ..... 100/45
52-48177 4/1977 Japan ..... 100/207
55-75897 6/1980 Japan ..... 100/207
55-86700 6/1980 Japan ..... 100/207

*Primary Examiner*—Billy J. Wilhite

*Attorney, Agent, or Firm*—Kane, Dalsimer, Kane, Sullivan and Kurucz

[57] ABSTRACT

A control device for a press secondary machining line includes a main control unit for controlling auxiliary control units which are provided respectively in operation blocks which are obtained by dividing the line in such a manner that each block includes one press, each auxiliary control unit controlling a press and a workpiece supplying and/or removing unit in its own block. Each auxiliary control unit includes a shift register for setting input data in response to a shift signal from the main control unit, a circuit for receiving a workpiece conveyance signal from the main control unit when the output of the shift register is raised to "1", a circuit for receiving a press operation signal from the main control unit when the shift register provides the output "1", and a shift register clear circuit for clearing the output "1" of the shift register, so that the presses are started successively at the start of the line operation and stopped successively at the end of the line operation, and when a defective workpiece is removed from a press during the line operation, the following presses are stopped one after another.

1 Claim, 3 Drawing Figures

PRESS SECONDARY MACHINING LINE CONTROL DEVICE

BACKGROUND OF THE INVENTION

This invention relates to a control device for a press secondary machining line which includes in combination at least two presses, a workpiece supplying unit, workpiece supplying and removing units, and a workpiece removing unit, these units being used to transfer or convey a workpiece which is formed by punching.

One example of a conventional press machining line is as shown in FIG. 1. A workpiece 2 conveyed by a belt conveyor 1 is loaded on a die 6 of a press 5 by the workpiece supplying hand 4 of a workpiece supplying unit 3. After being machined by the press 5, the workpiece 2 is removed to a stocker 9 by the workpiece removing hand 8 of a workpiece supplying and removing unit 7. The workpiece 2 on the stocker 9 is placed on a die 12 of another press 11 by the workpiece supplying hand 10 of the unit 7. After being pressed, the workpiece 2 is set on another stocker 15 by the workpiece removing hand of another workpiece supplying and removing unit 13. The workpiece 2 on the stocker 15 is placed on a die 18 of another press 17 by the workpiece supplying hand 16 of the unit 13. After being pressed, the workpiece 2 is removed by the workpiece removing hand 20 of a workpiece removing unit 19 and is then conveyed by a belt conveyor 21.

A variety of control devices are available for such a press secondary machining line as described above; however, a control device of the type that all presses in a line are operated simultaneously, is desirable because the control is simple and the number of times of machining per minute is relatively large. In order to operate the presses simultaneously, centralized control should be employed for the entire line. In the centralized control, all the control devices may be installed on one control board. However, in this case, the number of presses in a line is unavoidably limited, because the control devices should have different functions depending on the number of presses, and the number of workpiece supplying and removing units and the kinds of the same. Accordingly, it is rather difficult to increase or decrease the number of presses in a line. Furthermore, the centralized control system involves a problem to be solved that at the start of the operation, the presses should be operated one after another, and at the end of the operation the presses should be stopped successively; and a problem that, when a defective workpiece is removed from a press during the operation, the following presses must be stopped successively.

SUMMARY OF THE INVENTION

Accordingly, an object of this invention is to provide a control device for a press secondary machining line, in which the number of presses in the line can be increased or decreased as desired, the presses are started successively at the start of the machining operation and are stopped one after another at the end of the operation, and when a defective workpiece is removed from a press during the machining operation, the following presses can be stopped successively.

The foregoing object and other objects of the invention have been achieved by the provision of a control device for a press secondary machining line, which comprises: a main control unit; and auxiliary control units which are provided respectively in operation blocks which are obtained by dividing a press secondary machining line in such a manner that each operation block has a press, each auxiliary control unit controlling a press and a workpiece supplying and/or removing unit in the respective block in response to a signal from the main control unit, the main control unit comprising: a shift signal transmitting circuit for transmitting a shift signal; a workpiece conveyance signal transmitting circuit for transmitting a workpiece conveyance signal; a press operation signal transmitting circuit for transmitting a press operation signal; and a data switching circuit for transmitting data at a logic level "1" at the start of a press machining operation and during the press machining operation, and for transmitting data at a logic level "0" at the end of the press machining operation, each auxiliary control unit comprising: a shift register for loading input data in response to the shift signal from the shift signal transmitting circuit; a conveyanze signal receiving circuit for receiving the workpiece conveyance signal from the workpiece conveyance signal transmitting circuit when the shift register provides an output at a logic level "1;" a press operation signal receiving circuit for receiving the press operation signal from the press operation signal transmitting circuit when the shift register provides the output at the logic level "1;" and a shift register clear circuit for clearing the output at the logic level "1" of the shift register, the data input terminals and the output terminals of the shift registers in the auxiliary control units being connected in series to the data switching circuit in the main control unit.

The nature, principle and utility of the invention will become more apparent from the following detailed description when read in conjunction with the accompanying drawings:

DETAILED DESCRIPTION OF THE INVENTION

Figure 2:
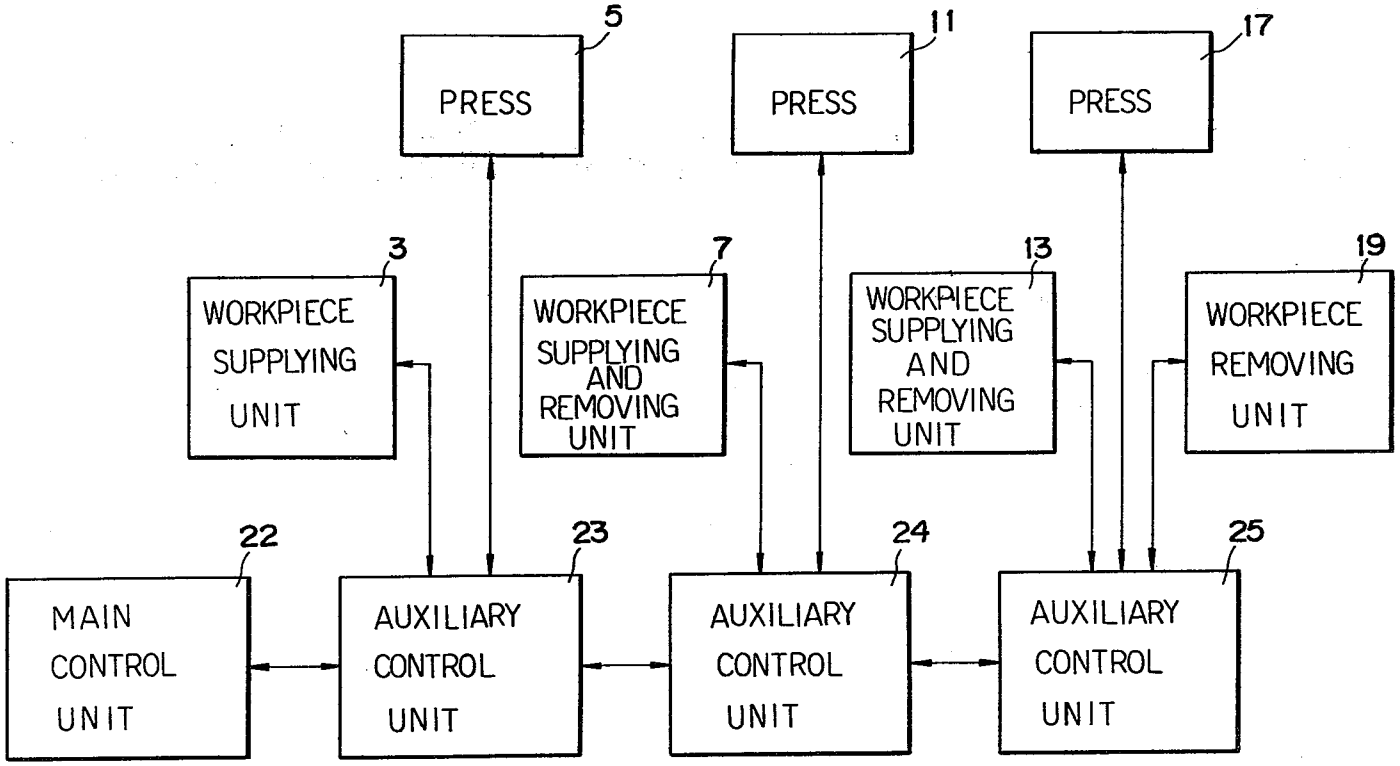
FIG. 2 is a block diagram showing relationships between one embodiment of this invention and a press secondary machining line.

A control device according to this invention, as shown in FIG. 2, comprises main control unit 22 and auxiliary control units 23, 24 and 25. In the case of FIG. 2, a press secondary machining line consists of a block of a press 5 and a workpiece supplying unit 3, a block of a press 11 and a workpiece supplying and removing unit 7, and a block of workpiece supplying and removing unit 13, a press 17 and a workpiece removing unit 19. These blocks have the aforementioned auxiliary control units 23, 24 and 25, respectively. The auxiliary control units 23, 24 and 25 directly control the operations of the presses 5, 11 and 17 and the operations of the workpiece supplying unit 3, workpiece supplying and removing units 7 and 13 and workpiece removing unit 19 (hereinafter referred to as "conveying units," when applicable) in response to signals from the main control unit 22.

Figure 3:
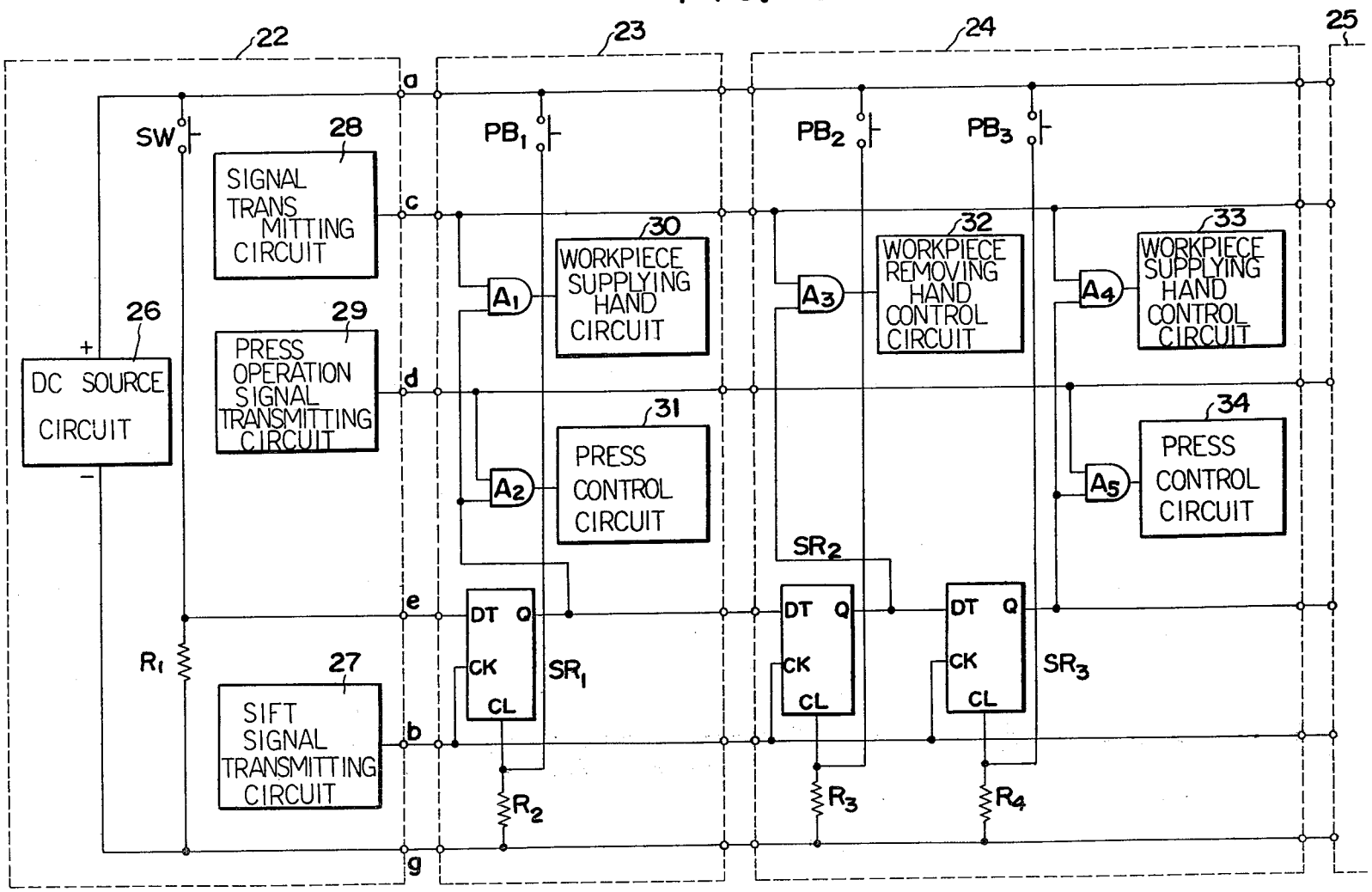
FIG. 3 is a block diagram showing the embodiment of the invention.

Examples of the main control unit 22 and the auxiliary control units 23 and 24 are as shown in FIG. 3.

The main control unit 22 comprises: a DC source circuit 26; a shift signal transmitting circuit 27 for transmitting a shift signal; a conveyance signal transmitting circuit 28 for transmitting a workpiece conveyance signal; a press operation signal transmitting circuit 29 for transmitting a press operation signal; and a data switching circuit having a data change-over switch SW and a resistor $R_1$, for transmitting data at a logic level "1" or "0" (hereinafter referred to merely as "1" or "0," when applicable). In the auxiliary control units 23 and 24, shift registers $SR_1$, $SR_2$ and $SR_3$ are D flip-flops. The data input terminals DT and output terminals Q of these shift registers are connected in series to the data output terminal e of the main control unit 22. The clock terminals CK of the shift registers $SR_1$, $SR_2$ and $SR_3$ are connected in parallel to the shift signal output terminal b of the main control unit 22.

Conveyance signal receiving circuits $A_1$, $A_3$ and $A_4$ and press operation signal receiving circuits $A_2$ and $A_5$ are AD gates which are connected in parallel to the conveyance signal output terminal c and the press operation signal output terminal d of the main control unit 22, as shown in FIG. 3. Shift register clear switches $PB_1$, $PB_2$ and $PB_3$ and registers $R_2$, $R_3$ and $R_4$ form shift register clear circuits, respectively, which and connected between the DC source output terminals a and g of the main control unit 22.

When a press maching operation is started, the data change-over switch SW in the main control unit 22 is closed, whereupon a signal at "1" is applied to the data input terminal DT of the shift register $SR_1$. Next, the shift signal generating circuit 27 is operated to output a pulsive shift signal through the shift signal output terminal b. Therefore, at the rise of the shift signal applied to the clock terminal CK of the shift register $SR_1$, the latter $SR_1$ loads a data input at "1," and outputs a signal at "1" through its output terminal Q. In the main control unit 22, the conveyance signal transmitting circuit 28 is operated to putput a pulsive workpiece conveyance signal through its conveyance signal output terminal c. In this case, the conveyance signal receiving circuit $A_1$, receiving the output at "1" of the shift register $SR_1$, is opened. Therefore, the workpiece conveyance signal is applied through the conveyance signal receiving circuit $A_1$ to a workpiece supplying hand circuit 30, whereby the latter 30 is operated. As a result, the workpiece supplying hand 4 in the workpiece supplying unit 3 loads a workpiece 2 on a metal mold 6. When conventional means detects the loading of the workpiece 2 on the metal mold 6, the main control device 22 operates the press operation signal transmitting circuit 29, whereupon a pulsive press operation signal is applied to a press control cicruit 31 through the press operation signal receiving circuit $A_2$ which is opened by the output at "1" of the shift register $SR_1$. As a result, the press 5 is operated.

Figure 1:
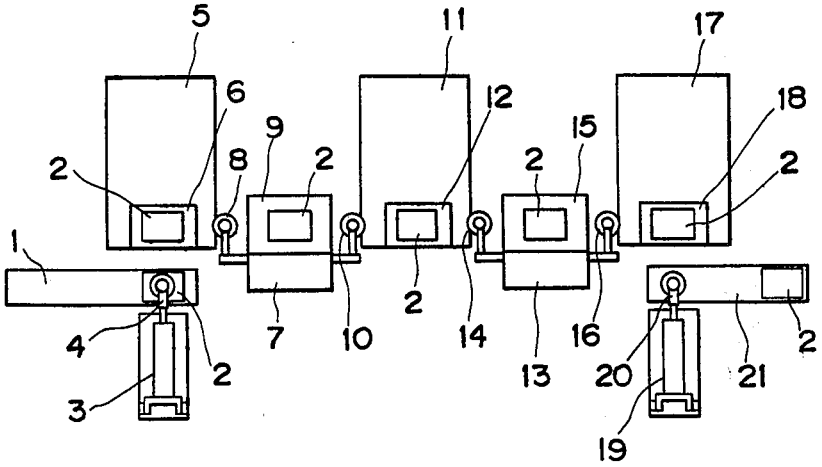
FIG. 1 PRIOR ART
FIG. 1 is a plan view of a conventional press secondary machining line.

After detecting when the operation of the press 5 is accomplished, the main control unit 22 operates the shift signal transmitting curcuit 27. In this case, the output at "1" of the shift register $SR_1$ is applied to the data input terminal DT of the shift register $SR_2$. Therefore, when the shift signal from the main control unit 22 is applied to the clock terminal CK of the shift register $SR_2$, the latter $SR_2$ loads the input data "1", and therefore the output level is changed to "1" from "0". As a result, the conveyance signal receiving circuit $A_3$ is opened. In response to the workpiece conveyance signal from the main control circuit 22, the workpiece removing hand control circuit 32 operates to cause the workpiece removing hand 8 of the workpiece supplying and removing unit 7 to remove the workpiece 2 from the die 6 and to send it to a stocker 9 (FIG. 1). At the same time, in response to the workpiece conveyance signal, a workpiece supplying hand control circuit 30 operates to cause the workpiece supplying hand 4 to load another workpiece 2 on the die 6. In response to the next press operation signal, the press control circuit 31 operates to start the operation of the press 5.

When the next shift signal is produced, the output "1" of the shift register $SR_2$ has been applied to the data input terminal DT of the shift register $SR_3$, and therefore the shift register $SR_3$ loads the output signal "1". At the same time, all the outputs of the shift registers $SR_1$, $SR_2$ and $SR_3$ are raised to "1". As a result, the conveyance signal receiving circuits $A_1$, $A_3$ and $A_4$ and the press operation signal receiving circuits $A_2$ and $A_5$ are opened. In response to the next workpiece conveyance signal, the workpiece supplying hand control circuit 30, the workpiece removing hand control circuit 32 and a workpiece supplying hand control circuit 33 operates simultaneously, so that the workpiece 2 are delivered to the presses 5 and 11 by the workpiece supplying hands 4 and 10, respectively, and the workpiece 2 is removed from the press 5 by the workpiece removing hand 8. In response to the next press operation signal, under this condition, the presses 5 and 11 are operated simultaneously.

The auxiliary control unit 25 is similar in arrangement to the auxiliary control unit 24. This shift registers in the auxiliary control unit 25 load the signals "1" successively, so that the workpiece removing hand 14, the workpiece supplying hand 16 and the press 17 are operated successively. The operation of the workpiece removing unit 19 should follow the operation of the press 17, and therefore it is unnecessary to provide a shift register and a conveyance signal receiving circuit for the workpiece removing unit 19.

During the machining operation, the data change-over switch SW is maintained closed, and therefore the outputs of the shift registers $SR_1$ through $SR_3$ are at "1". Accordingly, the presses 5, 11 and 17 and the units 3, 7 and 13 are operated simultaneously.

When the machining goperation has been accomplished, the data change-over switch SW is opened, so that the signal "0" is outputted through the data output terminal e. The signal "0" is applied to the data input terminal DT of the shift register $SR_1$, and therefore in response to the shift signal the output of the shift register $SR_1$ is set to "0". Whenever the shift signal is produced, the outputs of the following shift registers are set to "0" successively, and therefore the presses and the conveying units are stopped successively. Accordingly, no workpieces which are not finished yet are left in the dies or the stocker, after the machining operation.

When, during the machining operation, a workpiece 2 is found defective and removed from the line, the condition that there is no workpiece occurs in some of the presses. Therefore, in this case, it is necessary to stop the operations of the presses and the workpiece conveying units to which no workpiece is supplied. This can be achieved by closing the shift register clear switches $PB_1$ through $PB_3$. It is assumed that the workpiece 2 machined by the press 5 is defective and it is removed from the die 6. In this case, the shift register clear switch $PB_2$ is closed, so that a positive voltage is applied through the DC source output terminal a to the clear terminal CL of the shift register $SR_2$. As a result, the output of the shift register $SR_2$ is set to "0" and the conveyance signal receiving circuit $A_3$ is closed. Accordingly, when the next workpiece conveyance signal is produced, the workpiece removing hand control circuit 32 is not operated and accordingly the workpiece removing hand 8 is not operated. This operation affects the following circuits: the output of the shift register $SR_3$ is set to "0," the workpiece supplying hand control circuit 33 is not operated, and the press control circuit 34 is not operated.

Heretofore, a control method is, in general, employed in which it is confirmed whether or not the presses and the workpiece conveying units are operated satisfactorily and it is also detected whether or not the workpiece conveying units hold workpieces, so that, when no workpiece is held thereby, the operation is stopped. On the other hand, according to the invention, the operations of the workpiece conveying unit and the press which hold no workpiece can be stopped by designing the control device so that the shift register clear switches $PB_1$ through $PB_3$ are automatically closed when no workpiece is held.

In FIG. 3, the circuits $A_1$ through $A_5$ are the AND gates, as described before; however, the same operations can be effected by a programmable logic control using a microprocessor or the like. In this case, instead of the D flip-flops, data storing registers can be employed. The main control unit 22 and the auxiliary control unit 23 may be formed into one unit by arranging them on one control board. Furthermore, the press 5, the workpiece supplying hand 4 and the workpiece 8 may be combined as one block; the press 11, the workpiece supplying hand 10 and the workpiece removing hand 14 as one block; and the press 17, the workpiece supplying hand 16 and the workpiece removing hand 20 as one block.

As is apparent from the above description, the control device according to the invention comprises: the main control unit; and the auxiliary control units which are provided respectively in the blocks of the press secondary machining line, which include the respective presses, each auxiliary control unit controlling the press and the workpiece supplying and removing unit in the respective block in response to the signals from the main control unit. Therefore, the number of presses in the press secondary machining line can be increased or decreased by increasing or decreasing the number of auxiliary control units. Thus, the number of presses in the line can be readily adjusted.

The auxiliary control units have the shift registers. In response to the shift signal from the shift signal transmitting circuit in the main control unit, the data are transmitted from the shift register closest to the main control unit to one farthest from the main control unit. When the output of the shift register is at "1," the press and the workpiece conveying unit are operated; and when the output is at "0," the press and the workpiece conveying unit are not operated. Therefore, when the machining operation is started, the operations in the blocks are carried out successively; and when the machining operation is finished, the operations in the blocks are stopped successively.

The auxiliary control units have the shift register clear circuits to clear the outputs "1" of the shift registers. Therefore, when a workpiece is removed from the line during the machining operation, by clearing the output "1" of the shift register in that block the operations in the block and the following blocks can be stopped successively as the condition that there is no workpiece in a block is succeeded by the blocks.

What is claimed is:

1. A control device of a press secondary machining line, which comprises:

a main control unit; and auxiliary control units which are operatively coupled to said main control unit and provided respectively in operation blocks which are obtained by dividing a press secondary machining line in such a manner that each operation block includes a press, each auxiliary control unit controlling a press and a workpiece supplying and/or removing unit in the respective block in response to a signal from said main control unit, said main control unit comprising: a shift signal transmitting circuit for transmitting a shift signal; a workpiece conveyance signal transmitting circuit for transmitting a workpiece conveyance signal; a press operation signal transmitting circuit for transmitting a press operation signal; and a data switching circuit for transmitting data at a logic level "1" at the start of a press machining operation and during the press machining operation, and for transmitting data at a logic level "0" at the end of the press machining operation, each auxiliary control unit comprising: a shift register for loading input data in response to said shift signal from said shift signal transmitting circuit; a conveyance signal receiving circuit for receiving said workpiece conveyance signal from said workpiece conveyance signal transmitting circuit when said shift register provides an output at a logic level "1;" a press operation signal receiving circuit for receiving said press operation signal from said press operation signal transmitting circuit when said shift register provides the output at the logic level "1;" and a shift register clear circuit for clearing the output at the logic level "1" of said shift register, data input terminals and output terminals of said shift registers in said auxiliary control units being connected in series to said data switching circuit in said main control unit.

* * * * *